United States Patent [19]

Pasini

[11] Patent Number: 4,997,141

[45] Date of Patent: Mar. 5, 1991

[54] YARN DYE TUBE

[75] Inventor: Roberto Pasini, Milan, Italy

[73] Assignee: Tubettificio Europa S.p.A., Milan, Italy

[21] Appl. No.: 454,195

[22] Filed: Dec. 21, 1989

[30] Foreign Application Priority Data

Dec. 28, 1988 [IT] Italy ..... 23131 A/88

[51] Int. Cl.[5] ..... B65H 75/20

[52] U.S. Cl. ..... 242/118.1; 242/125.1

[58] Field of Search ..... 242/118.1, 118.11, 118.3, 242/118.31, 118.32, 125.1; 68/189, 198

[56] References Cited

U.S. PATENT DOCUMENTS 4,331,305 5/1982 Marquis et al. ..... 242/118.11
4,702,433 10/1987 Gilliam et al. ..... 242/118.1
4,760,976 8/1988 Burchette, Jr. ..... 242/118.11
4,789,111 12/1988 Thomas et al. ..... 242/118.1
4,872,621 10/1989 Thomas ..... 242/118.11
4,941,621 7/1990 Pasini ..... 242/118.1

FOREIGN PATENT DOCUMENTS 0257268 3/1988 European Pat. Off. ..... 242/118.1

*Primary Examiner*—Stanley N. Gilreath

[57] ABSTRACT

A dye carrier for yarn packages comprises a tubular body having a yarn winding surface and yarn tailing means at one end of the body for winding up a yarn tail. The yarn tailing means comprises a cylindrical tailing surface of smaller diameter for winding up the yarn tail, a protective annular member between the tailing surface and the yarn winding up surface to prevent damage of the tail, and centering means at both ends of the body defining an annular yarn retaining shoulder to axially align stacked dye tubes.

9 Claims, 2 Drawing Sheets

YARN DYE TUBE

BACKGROUND OF THE INVENTION

This invention relates to improved dye tubes or tubular carriers for winding up yarns, hereinafter referred to also as "dye tubes", both of the rigid and collapsible or elastically yielding types and in particular is concerned to a cylindrical dye tube for winding up textile threads or yarns, which is provided with a protective tailing surface portion for winding up a length of tail of yarn, required to guarantee the continuity of yarn between adjacent tubes. The invention relates also to an axially compressible dye tube suitable for preventing the yarn from being damaged during stacking and compression of the tubes during dyeing.

The invention also relates to a dye tube made by injection molded plastic materials comprising end flanges and intermediate ring elements interconnected by collapsible and breakable stiffening elements providing a cylindrical yarn winding up surface.

The term "year" used hereinafter refers to any twisted textile yarn or any type of continuous textile thread of filament.

As is known, in the dyeing treatment of yarns, a plurality of tubes each wound with a respective package of yarn, are axially aligned and introduced into an autoclave, in which a dye bath is circulated.

To this end use is made of rigid or elastically compressible tubes of the type comprising a cylindrical body having a longitudinal axis and an outer yarn winding up surface, as well as surface means at one end of said body for winding up an yarn tailing. The body of the dye tube is moreover provided with openings or apertures on its peripheral surface, or the same yarn winding up surface is defined by coaxially arranged range elements joined by cross or spirally-shaped stay elements distributed peripherally at the body of the tube in order to define a rigid and/or elastically compressible or collapsible dye carrier having an open network on the yearn winding surface which enables the passage of the dye bath.

The dye tubes currently in use, do not enable the yarn to be adequately supported in an axial direction during compression as a consequence of the particular confirmation and structure of the tubes themselves; consequently due to the consideration distance between an yarn package on one tube and the package on the adjacent tube, spacing discs must be placed between one yarn package and another in order to prevent uneven compression of all stacked yarn packages. This solution is however disadvantageous since, during preparation of the yarn packages to be introduced into the dyeing autoclave, a considerable quantity of intermediate discs must be positioned between the tubes with a resulting loss of time; moreover the space occupied by the discs is wasted uselessly in the dyeing autoclave thus reducing its productivity.

A further problem connected with the previous dye tubes liens in the danger of breaking the tailing yarn on each tube causing in turn an undesirable penetration of the tailing yarn into the yarn package wound on the same tube.

The main object of this invention is to provide a tubular dye carrier for yarn packages by means of which it is possible to wind a tailing yarn on a suitably protected surface area of the tube, and with which it is possible to support the yarn package adequately allowing it to come into direct contact with the package or packages of adjacent tubes during compression, in this way eliminating the use of intermediate separating discs.

A further object is to provide a dye tube as referred to previously by means of which it is possible to stack one tube on another thus reducing the space occupied in a dyeing autoclave at the same time maintaining the tubes centered and axially aligned for an appropriate compression.

A further object of this invention is to provide a tubular dye carrier for yarn packages as referred to previously, by means of which it is possible to further avoid the problem of damage to the yarn during compression, at the same time ensuring the passage of a dye bath through the tube and even distribution in the mass of yarn.

A further object again of the invention is to provide a dye tube having non-collapsible ends which provide a sliding surface for the yarn package during compression.

SUMMARY OF THE INVENTION

The aforementioned objects can be achieved by means of the structure of a tubular dye carrier for yarn packages comprising a tubular body having a yarn winding surface and yarn tailing means at one end of the body for winding up an yarn tail. The yarn tailing means comprises a cylindrical tailing surface of smaller diameter for winding up the yarn tail, a protective annular member between the tailing surface and the yarn winding up surface to prevent damage of the tail, and centering means at both ends of the body defining an annular yarn retaining shoulder to axially align stacked dye tubes.

Therefore, advantageously, the dye tube according to this invention comprises a disposition of the winding surface for the tailing yarn which is positioned laterally and decentralised in relation to the cross plane of symmetry of the tube which enables the formation of an intermediate annular flange provided with suitable shoulder surfaces which in combination with an annular centering element enable two or more tubes to be arranged in a stacked conduction, thus reducing the space occupied; the particular conformation of the flange moreover prevents the tailing yarn from breaking or from being damaged during compression, or broken between stacked tubes.

The decentralised arrangement, in an axial direction, of the yarn winding surface and the provision of axial sliding surfaces for the yarn package in correspondence with the two ends of the tube body or of the yarn winding surface means that at the start of the tube compression phase, the ends of the latter can slide a short length in the axial direction in relation to its own package without damaging it, bringing the end of the package on a tube closer to an in contact with the package on an adjacent tube.

BRIEF DESCRIPTION OF THE DRAWINGS

The invention will be described in greater detail hereunder with reference to the example of the accompanying drawings which show a compressible dye tube whose degree of compression is suitably controlled, nevertheless it is clear that the invention is not restricted to the tube shown. In the drawings.

DESCRIPTION OF THE INVENTION

Figure 1:
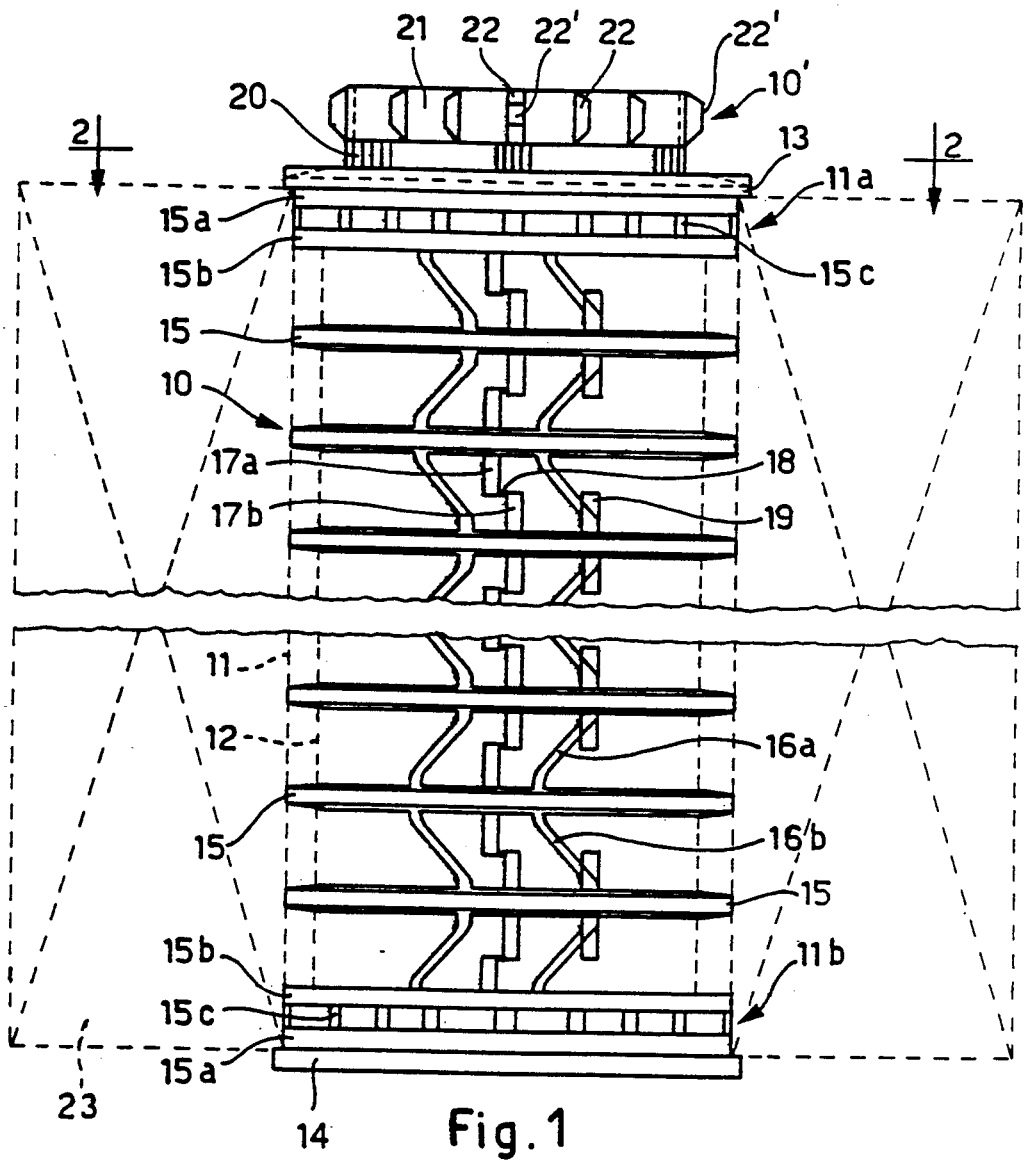
FIG. 1 shows a side view of a compressible tube incorporating the improvements according to the invention.

The dye tube or carrier for yarn packages shown in FIG. 1, comprises a tubular body 10 having an internal diameter 12 and an external diameter defining a cylindrical surface 11 for winding up a package of yarn 23 as explained further on.

The tube extends to one end of the body 10, from an intermediate flange 13, with a cylindrical part having an annular centering member 10' smaller in diameter, suitable for being inserted in the opposite open end of an adjacent tube, when several tubes are stacked or placed on top of each other and arranged for example inside a dyeing autoclave.

The yarn winding up surface 11 on the body 10 for winding up the yarn package, is positioned between an end flange 13 in correspondence with the extension 10' and an end flange 14 at the opposite end, having maximum diameters slightly greater than that of the yarn winding surface 11 to form annular shoulders for axially retaining the yarn package 23. Between the flanges 13 and 14 there is a plurality of intermediate annular elements 15, evenly spaced apart along the longitudinal axis of the tube, said annular elements having their external diameter defining the yarn winding surface 11 referred to previously. The intermediate rings 15 are connected to each other by means of a plurality of yielding connecting elements or stay members **16*a*, 16*b*, parallelly arranged to the cylindrical yarn winding surface 11. The yielding stays 16*a*, 16*b* are evenly spaced apart along each ring 15 and are moreover slanted at an angle to the longitudinal axis of the tube, so that the yielding elements 16*a* which are positioned on the same side of each ring 15 are slanted in opposite directions to the yielding elements 16*b* on the opposite side of the same ring. In this way a structure is obtained which guarantees axial or substantially axial compression of the tube and hence of the yarn package 23** wound on it.

Optionally, as represented schematically in FIG. 1, the tube body 10 can comprise breakable stiffening elements in the form of opposed projections **17*a* and 17*b* which extend in an axial direction to each other from adjacent rings 15; corresponding projections 17*a* and 17*b* between adjacent rings are arranged one beside the other in close proximity and connected to each other in a breaking point 18 which initially ensures the required stability and axial rigidity of the tube during the winding of the yarn, but which can easily be broken during compression of the tube. These breakable stiffening elements 17*a*, 17*b* together with projections 19 in correspondence with the attachment points for the yielding stays 16*a* and 16*b* to the rings 15, defining stop means for limiting axial movement between the rings 15**.

According to this invention, the body 10 of the tube, at the two ends of the yarn winding surface 11, comprises cylindrical surfaces **11*a* and 11*b*** for the axial sliding of the yarn package, during compression.

As shown in FIG. 1, each sliding surface **11*a*, 11*b* of the yarn package is defined by two rings 15*a* and 15*b* closer than the rings 15, said rings 15*a*, 15*b* being joined by a plurality of spaced apart stiffening ribs 15*c* uniformly and peripherally disposed around the rings 15*a*, 15*b* so as to define a sliding surface 11*a*, 11*b* for the yarn package 23, during compression, having the same direction as the surface 11**.

Figure 2:
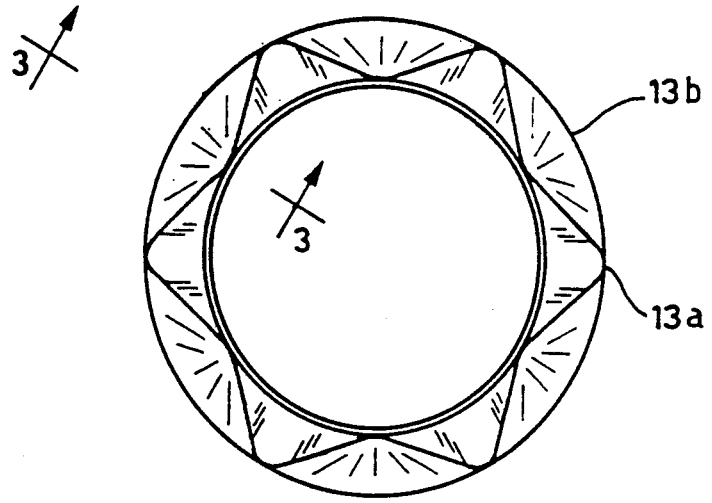
FIG. 2 is a top view along line 2—2 of FIG. 1.
Figure 3:
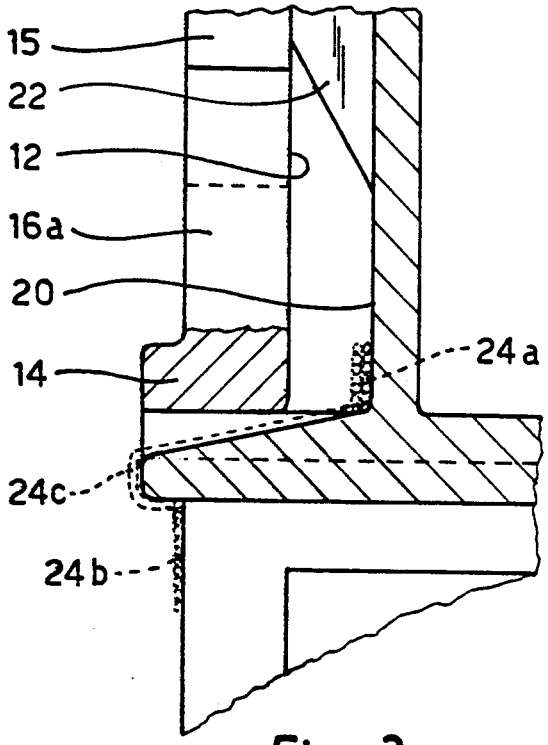
FIG. 3 is an enlarged cross-sectional view of a part of the tube, made along line 3—3 of FIG. 2.
Figure 4:
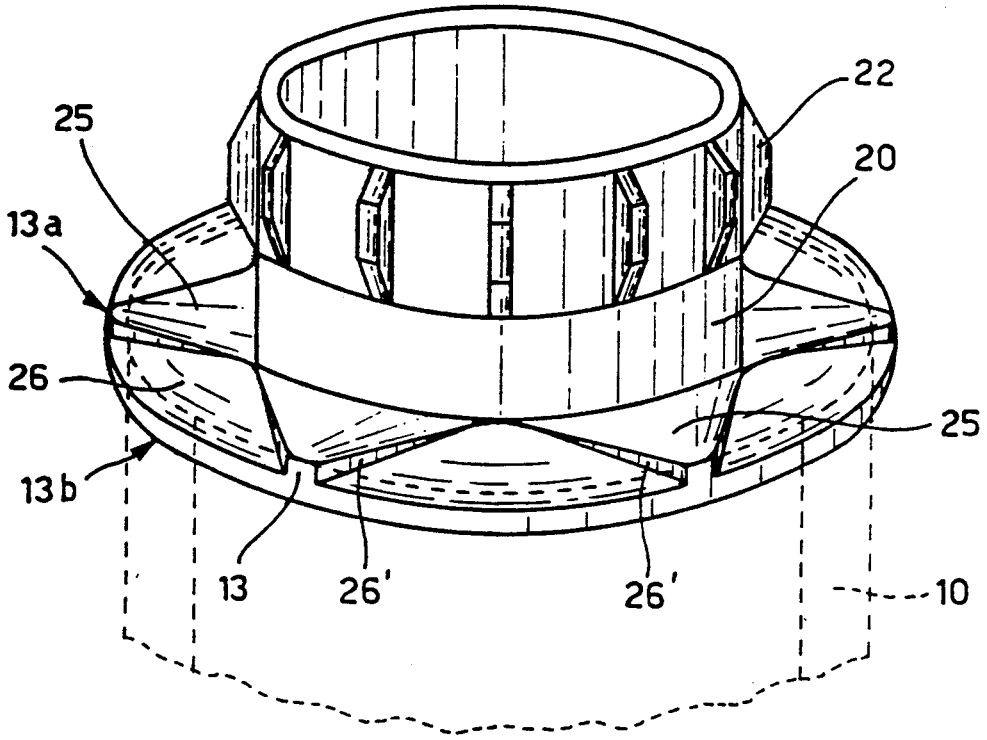
FIG. 4 is an enlarged perspective view of the end of the tube in FIG. 1, relating to the winding of the tailing yarn.

As related previously and as shown in the detail of FIGS. 2, 3 and 4, the tube according to the invention comprises an extension 10' of reduced diameter for centering stacked tubes and for winding a yarn tailing. In particular the extension 10' of the tube, starting from the flange 13, comprises a cylindrical surface 20 on which the yarn tailing is wound before the yarn package 23 is wound onto the tube. The surface 20 for winding the tailing yarn extends upwardly with an annular band 21 from which protrudes a plurality of radial finds 22 whose outer edges 22', parallel to the axis of the cylinder, define an annular surface having a diameter equal to or slightly smaller than the internal diameter 12 of the body of the tube; in this way the fins 22 define centering means which enable one end of a tube to be inserted into the opposite end of an adjacent tube maintaining a coaxial arrangement. It is clear that the band 21 and the fins 22 could be replaced by other equivalent means designed to guarantee centering of the tubes and free circulation of a treatment bath for the yarn.

As can be seen in FIG. 1, in a tube according to the invention, unlike conventional tubes, the yarn package 23 wound onto the surface 11 of the tube 10 is partially offset, that is to say displaced towards the end of the tube opposite that of the cylindrical extension 10' for the tailing yarn, coming in this way more in proximity of the yarn package of a successive tube, when several tubes are stacked each other.

As related previously, this is extremely advantageous for the arrangement of tubes in a dyeing autoclave, since it allows the elimination of traditional separator rings and therefore a saving in space and a reduction in working times, also enabling a uniform compression of the yarn packages since the latter come immediately into contact with each other, after the surfaces **11*a* and 11*b*** slide a short distance to the ends of the tube, at the start of compression.

FIGS. 3 and 4 of the drawings show further characteristics of the tube according to the invention. Said figures show the adoption of suitable protective means for preventing crushing and hence damage to the tailing yarn. For this reason the flange 13, in the example shown, comprises a plurality of triangular flange portions **13*a*, angularly spaced apart of separated from flange portions 13*b***, of lesser thickness, to define front indentations, that is to say a set of recessed portions in which to arrange the yarn without it being crushed.

In particular, as shown in FIG. 4, each flange portion **13*a*, of greater thickness is delimited by an upper surface 25, lying on a plane perpendicular to the longitudinal axis of the tube, which together with corresponding surface 25 of the other flange portions 13*a* define an annular shoulder surface against which the end ring 14 of a stacked tube 10 can rest or press, as represented schematically in FIG. 3. In a different manner, the intermediate flange portions 13*b* have an upper stub surface 26 which is slanted towards the outer edge of the flange. In this way, as represented schematically in FIG. 3, the length of yarn 24*c* which from the tailing 24*a* of one tube passes to the first layer 24*b* of yarn packages 23, can be placed or protected in a hollow space defined by the intermediate flange portions 13*b* of lesser thickness, preventing it from being damaged by the opposing surfaces of the end rings 13, 14 of the stacked tubes; the flange 13** also prevents the yarn tailing from coming into contact with the package.

Both the flange portions 13*a* of greater thickness and the flange portions 13*b* of lesser thickness, defining the hollow cavities for protecting the yarn, have preferably a triangular shape or circular sector and are define at the sides slanting indentations or stop surface 26' on planes parallel to the longitudinal axis of the dye tube, having a substantially tangential slant or forming an angle smaller than 45° so as to avoid that at the connecting portion 24*c* of the yarn passing from the tailing 24*a* to the first layer 24*b* of the package being positioned on the surface 25 of the flange portions 13*a*. In this way the surfaces 26' define lateral shoulder means for stopping the yarn which, at the beginning of the winding of the package 23, allow the same yarn to be dragged in rotation preventing it from sliding along the flange.

FIG. 4 shows a particular step profile of the flange 13 in which the surfaces 26 of the flange portions 13*b* of lesser thickness are in the form of flat surfaces slanted towards the outer edge of the flange; nevertheless the flange could have other circumferential profiles, suitable for achieving the intended purpose.

Other solutions are clearly possible within the sphere of the teachings provided by this invention.

What is claimed is:

1. A yarn dye tube comprising a cylindrical body having a longitudinal axis and a yarn winding surface having an outer diameter, and yarn tailing means at one end of said body for winding a tailing yarn, in which said yarn tailing means comprises a cylindrical tailing surface coaxially arranged to said yarn winding surface, said tailing surface having an outer diameter smaller than the outer diameter of said yarn winding surface, and a yarn protective means between said tailing surface and the yarn winding surface, said yarn protective means comprising an annular member radially extending from said tailing surface towards the outer surface of the tube body, said annular protective member comprising main shoulder surfaces angularly spaced apart from each other, and intermediate stub surfaces between said shoulder surfaces, said shoulder and stub surfaces defining yarn retaining means to prevent the yarn to slide on said stub surfaces, and centering means at ends of the tube body, said centering means comprising an annular element at one end of the body and an open portion at the other end of the body, whereby the annular element of a dye tube engages the open-end portion of a stacked dye tube.

2. A dye tube as in claim 1, in which said yarn retaining means comprises radially extending indentations on said protective annular member.

3. A dye tube as in claim 2, in which said stub surfaces are slanted towards the outer edge of protective annular member.

4. A dye tube as in claim 1, in which said main surfaces and said intermediate surfaces of the protective annular member have a substantially triangular shape.

5. A dye tube as in claim 1, in which said centering means comprises radial fins protruding from a tubular extension of the body of the tube.

6. A dye tube as in claim 1, in which said tube body comprises yarn sliding cylindrical surfaces at both ends of the yarn winding surface.

7. A dye tube as in claim 1, in which said cylindrical body comprises a plurality of coaxially arranged ring members connected by intermediate collapsible stay members in which the collapsible stay members on one side of each ring are slanted in an opposite direction to the collapsible stay members on the opposite side of the same ring.

8. A compressible yarn carrier for yarn packages comprising: a tubular body comprising a plurality of rings spaced apart along a longitudinal axis, said rings defining a cylindrical yarn winding surface, said rings moreover being connected by a plurality of yielding stay elements extending substantially parallel to the outer surface of the tube body, in an arrangement slanted at an angle to its longitudinal axis so as to allow axial compression of the carrier, and in which said carrier comprises an yarn tailing surface, in which said tailing surface is provided on a cylindrical extension at one end of the tube body smaller in diameter than the yarn winding surface, said cylindrical extension having tube centering means comprising fins projecting radially to said tailing surface, a circular flange between said tube body and said cylindrical extension, said circular flange having main flange portions of a predetermined thickness and angularly intermediate flange portions of smaller thickness than said main flange portions defining radial shoulder surfaces and in that the body of the carrier at both ends of the yarn winding surface comprises uncollapsible surfaces portions for axial sliding of the yarn package during compression.

9. A compressible dye tube according to claim 8, in which breakable stiffening members are provided between said rings.

* * * * *